US007997573B2

(12) United States Patent
Langenegger

(10) Patent No.: US 7,997,573 B2
(45) Date of Patent: Aug. 16, 2011

(54) PROCESS FOR FORMING STACKS OF PRINTED PRODUCTS, ESPECIALLY BOOKS, MAGAZINES, NEWSPAPERS AND BROCHURES, AND SYSTEM FOR IMPLEMENTING THE PROCESS

(75) Inventor: Daniel Langenegger, Brittnau (CH)

(73) Assignee: Müller Martini Holding AG, Hergiswil (CH)

( * ) Notice: Subject to any disclaimer, the term of this patent is extended or adjusted under 35 U.S.C. 154(b) by 465 days.

(21) Appl. No.: 12/004,108

(22) Filed: Dec. 18, 2007

(65) Prior Publication Data

US 2008/0179808 A1 Jul. 31, 2008

(30) Foreign Application Priority Data

Dec. 18, 2006 (EP) ..... 06 405 525.4-1251

(51) Int. Cl.
*B65H 37/04* (2006.01)

(52) U.S. Cl. ..... 270/52.18; 270/52.14; 270/52.16; 270/52.19; 270/52.2; 270/56; 270/58.07; 270/58.08; 270/58.29

(58) Field of Classification Search ..... 270/52.14, 270/52.16, 52.18, 52.19, 52.2, 52.21, 52.22, 270/52.23, 52.26, 52.29, 56, 58.07, 58.08, 270/58.09, 58.29
See application file for complete search history.

(56) References Cited

U.S. PATENT DOCUMENTS

| | | | | |
|---|---|---|---|---|
| 4,684,118 | A | 8/1987 | Boss et al. | |
| 5,599,009 | A * | 2/1997 | Mandel et al. | 270/58.09 |
| 6,237,908 | B1 * | 5/2001 | Chang et al. | 270/52.15 |
| 2003/0214092 | A1 * | 11/2003 | Horii et al. | 270/52.18 |
| 2004/0222584 | A1 | 11/2004 | Krieger et al. | |
| 2005/0082745 | A1 | 4/2005 | Williams et al. | |
| 2008/0012195 | A1 * | 1/2008 | Abegglen | 270/52.16 |

FOREIGN PATENT DOCUMENTS

| | | |
|---|---|---|
| EP | 1312568 | 5/2003 |
| EP | 1464604 | 10/2004 |

* cited by examiner

*Primary Examiner* — Leslie A Nicholson, III
(74) *Attorney, Agent, or Firm* — Lucas & Mercanti, LLP; Klaus P. Stoffel

(57) ABSTRACT

To form stacks of printed products such as books, magazines, newspapers, brochures, etc., a plurality of printed sheets is delivered by a conveying section and assembled thereon into preliminary products, which are then formed into stacks, where the process for collating the printed sheets into preliminary products is controlled as a function of the size of the stack of printed products to be formed. A device for implementing the process includes a collating device for forming preliminary products and an indirectly downstream stacking device connected to a control unit.

5 Claims, 1 Drawing Sheet

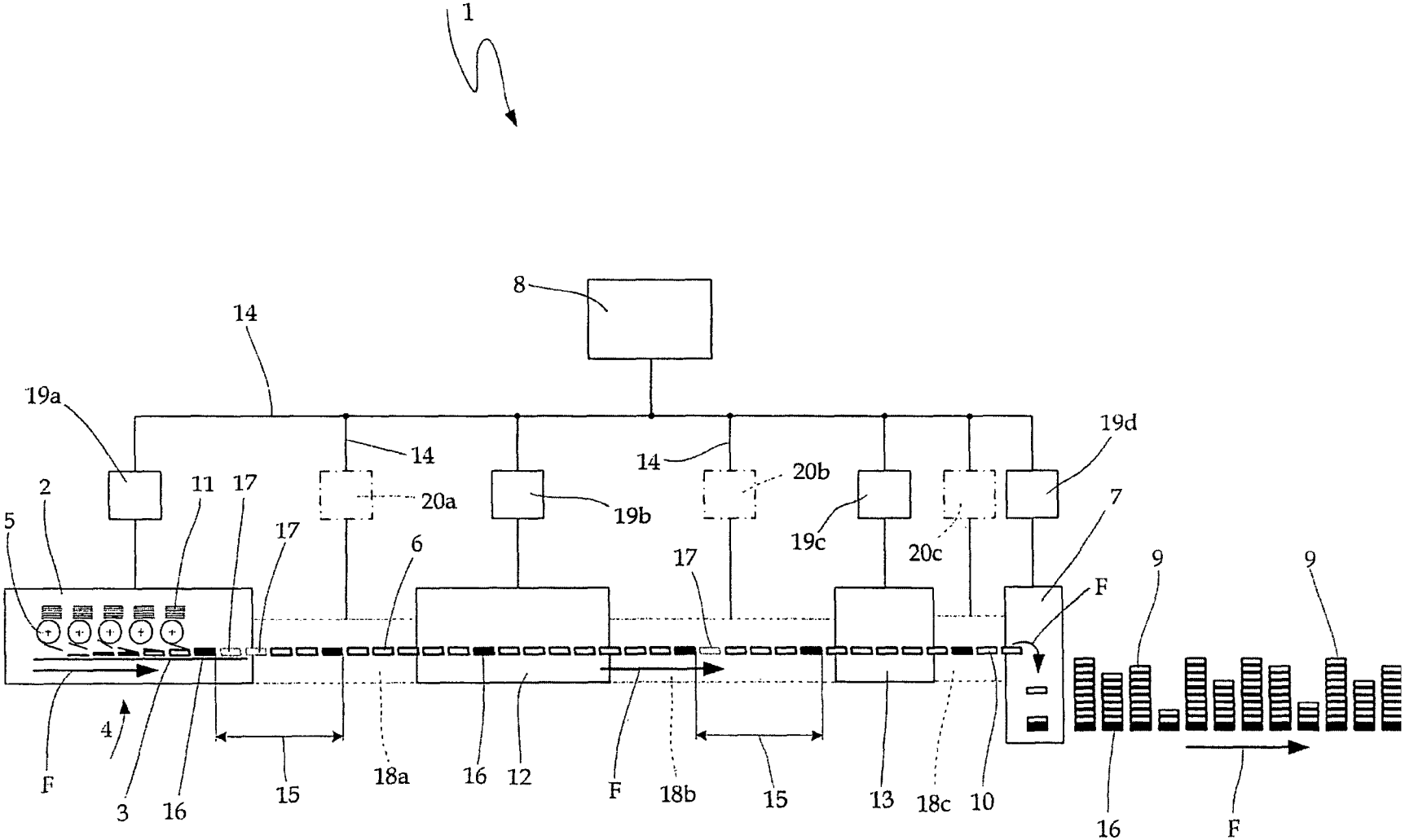
1
8
14
14
14
19a
19b
19c
19d
20a
20b
20c
2
5
11
17
17
6
12
16
16
3
4
F
15
15
18a
18b
18c
13
10
7
F
9
9
16
F

PROCESS FOR FORMING STACKS OF PRINTED PRODUCTS, ESPECIALLY BOOKS, MAGAZINES, NEWSPAPERS AND BROCHURES, AND SYSTEM FOR IMPLEMENTING THE PROCESS

BACKGROUND OF THE INVENTION

1. Field of the Invention

The present invention relates to a process for forming stacks of printed products, especially books, magazines, newspapers, brochures, etc., from a plurality of printed sheets which have been supplied by a conveying section and assembled thereon into preliminary products, wherein the preliminary products are then processed into stacks. The invention also relates and a system for implementing the process.

2. Description of the Related Art

Printed products, especially books, magazines, newspapers, brochures, and similar products are produced today primarily on production lines on an industrial basis. These types of production lines are formed by individual machines, which are arranged in a series, one behind the other. The individual machines are connected to each other. Each of these individual machines can have a maximum production speed, which depends on the product parameters and on the production conditions. The maximum possible production speed of the overall production line is therefore limited by the machine with the slowest maximum speed. The situation becomes especially serious when product parameters change constantly during production, i.e., parameters which influence the maximum production speed of the machine and limit the maximum production speed of the production line. This is the case, for example, in a stacking device which, as a function of the quantities ordered by different recipients, is called upon to form stacks of different sizes. For a stacking device there are two upper output limits, which cannot be exceeded. The first limit pertains to the maximum possible cadence at which the printed products can be accepted by the stacking device. The second limit pertains to the maximum possible cadence or the minimum possible cycle time at which a stack can be discharged from the stacking device. Because the maximum possible feed cadence is many times higher than the maximum possible discharge cadence, it is impossible to form stacks which are smaller than the quotient, rounded to the next higher whole number, of the maximum possible feed cadence divided by the maximum possible discharge cadence.

According to a first prior art reference, the problem is solved by using a distributing device to distribute the printed products over several parallel stacking devices and by then bringing the stacks back again to one line. With a sufficient number of stacking devices, it is possible to process the entire production output of the rest of the line at any time. The disadvantages, however, are the large number of machines required, the additional amount of space which the machines occupy, and the difficulty with which access can be gained to the individual stacking devices, which are set up parallel to each other.

According to a second prior art reference, the production output of the entire production line is reduced far enough during the formation of small stacks in the stacking device that there is sufficient time for the stacks to be discharged. The disadvantage of this solution, however, is that, as a result of the constant change in the production output, the quality of the printed products and the reliability of the production line can be negatively affected.

According to yet another prior art reference, a product buffer is inserted upstream of the stacking device. This buffer can be filled with printed products during the formation of small stacks and emptied again during the formation of large stacks. This solution also suffers from the disadvantage that a large number of additional machines and control functions are required. Furthermore, the buffer can become overfilled, when a large number of small stacks are to be formed in succession.

SUMMARY OF THE INVENTION

Therefore, it is the object of the present invention to maintain the production speed in a production line for the production of stacks of printed products regardless of the size of the stacks of printed products to be formed in the stacking device.

According to the invention, this object is met task is by controlling the process of collating printed sheets to obtain preliminary products as a function of the size of the stacks of printed products to be formed.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE shows a schematic and highly simplified diagram of a production line for printed products.

DESCRIPTION OF THE PREFERRED EMBODIMENTS

The single FIGURE shows a production line 1 for the production of stacks 9 of books, magazines, newspapers, brochures, or similar printed products 10. The production line is formed by a series of machines or devices 2, 12, 13, 7, which are arranged in series, one behind the other, and are connected to each other. A control unit 8 is provided to control the production line 1; this control unit is connected to the machine controllers 19*a, b, c, d* of the devices 2, 12, 13, 7 by signal lines 14, preferably a data bus device.

In a collating device 2, printed sheets 11 are combined successively into preliminary products 6 by feeder units 5, arranged along a conveying section 3 of a conveyor device 4. For this purpose, the conveyor device 4 has receiving points, which are arranged at regular intervals along a continuous traction means and which are loaded with different printed sheets 11 by the feeder units 5. Thus, the magazine of each feed device contains a stack consisting of only a single type of printed sheet 5, which is to be combined with one of each of the other types of printed sheets. As it passes by one of the individual feeder units 5, each receiving point is loaded with one of the printed sheets 11, so that, by the time it reaches the end of the conveying section 3, each receiving point holds a complete preliminary product 6. Depending on the way in which the printed products 10 are produced, the collated sheets 11 of the preliminary products 6 are stacked on top of each other or inserted into each other.

In a downstream binding device 12, which can be an adhesive binder or a stitcher, the spines of the preliminary products 6, preferably provided with a cover, are bound with adhesive or with staples.

A cutting system 13, which cuts the printed products 10 along three edges, can be provided after the binding device 12.

In a stacking device 7, the printed products 10 are then formed into stacks 9 of different sizes.

Between the devices 2, 12, 13, 7, additional conveying devices 18*a, b, c* can be provided if the preliminary products 6 or printed products 10 cannot be transferred directly from one of the devices 2, 12, 13 to the downstream device 12, 13, 7. Controllers 20*a, b, c* can be assigned to the conveying devices 18*a, b, c*; like the machine controllers 19*a, b, c*, these controllers are also connected to the control unit 8.

All of the devices 2, 12, 13, 7 of a production line 1 are preferably driven with angular synchrony, so that all of the units 2, 12, 13, 7 of the production line 1 can produce with the same cycle time and in synchrony with each other. At the start of the production of an order, it must be established how large the individual stacks 9 of printed products 10 to be formed are supposed to be and in what sequence they are to be produced. If the printed products 10 are to consist of different sets of printed sheets as a function of the recipient, the appropriate data must also be made available. All these data are filed in the control unit 8 or can be read out by the control unit 8 from a database. So that production can be carried out in this way, each printed product 10 must be monitored at all times during its production.

The necessary tracking of the preliminary products 6 or of the printed products 10 during their production within the production line 1 is the task of the control unit 8 with the help of the controller 19*a* of the collating device 2, the controller 19*b* of the binding device 12, the controller 19*c* of the cutting device 13, the machine controller 19*d* of the stacking device 7, and the controllers 20*a, b, c* of the conveying devices 18*a, b, c*. From the minimum cycle time of the stacking device 7 for discharging a stack 5 of printed products 10 and the cycle time at which the production line 1 produces, it is possible to calculate the minimum number of cycles which the stacking device 7 needs to form a stack 9 or to calculate the minimum size of a stack 9, wherein the cycle time for collating or producing the printed products 10 is multiplied by the minimum cycle time for forming a stack 9 and the result is rounded up to the next larger whole number. If, for example, the cycle time for collating is 4.5 cycles/second and the minimum cycle time is 0.9 second, multiplication yields a value of 4.05 and thus a minimum stack size of 5 copies. The minimum stack size is preferably calculated by the machine controller 19*d*. The minimum cycle time depends on the production parameters such as the length, width, and thickness of the printed products 10 to be produced and on the design of the stacking device 7. Because the machine controller 19*d* is connected to the control unit 8 by the signal line 14, the minimum stack size can be calculated in the control unit.

If stacks 9 with fewer than the minimum number of cycles or printed products 10 are to be formed, the control unit 8 inserts the difference as so-called "empty" cycles 17. It is therefore possible, without changing the cycle time of the production line, to produce stacks which are as small as desired. For the sake of illustration, the single FIGURE shows the first printed products 16, i.e., the products which are at the bottom of the stack 9, in dark color. In the case of the production process shown in the FIGURE, it is assumed, for example, that at least five cycles are required for the formation of a stack. This means that the distance 15 between immediately succeeding, lowermost printed products 16 corresponds to at least 5 cycles. The difference between 5 cycles and the cycles for forming a smaller stack is filled by a corresponding number of empty cycles 17. This filling with empty cycles 17 is an interruption of the collating process.

While specific embodiments of the invention have been described in detail to illustrate the inventive principles, it will be understood that the invention may be embodied otherwise without departing from such principles.

I claim:

1. A method for forming stacks of printed products, from a plurality of printed sheets which have been delivered along a conveying section and assembled thereon into preliminary products and processing preliminary products into printed products, which are then made into stacks, the method comprising: controlling the process of collating the printed sheets into preliminary products as a function of the size of the stacks of the printed products which are to be formed; interrupting the process of collating when the size of the stack falls below a certain size determined by the number of printed products; and determining the stack size leading to the interruption of the process by the product of the cycle time of the process of collating and the minimum cycle time for forming a stack.

2. The method according to claim 1, for adhesively bound preliminary products, comprising sending the products to an adhesive binding device to form spines.

3. The method according to claim 1, for stapled preliminary products or printed products, comprising sending the products to a stapling device to form spines.

4. The method according to claim 1, for preliminary products which are inserted into each other for obtaining printed products.

5. The device for implementing the process according to claim 1, consisting of a collating device with feeder units arranged along a conveying device to form a conveying section for the formation of preliminary products and an indirectly downstream stacking device, wherein a programmable control unit, which is connected to the collating device and to the stacking device, is provided to control the collating device.

* * * * *